US005193906A

United States Patent [19]

Neufeldt et al.

[11] Patent Number: 5,193,906

[45] Date of Patent: Mar. 16, 1993

[54] HEATER FOR A MORTAR PREPARATION SYSTEM

[75] Inventors: Allen A. Neufeldt, Willowdale; Bryan Kieswetter, Waterloo, both of Canada

[73] Assignee: B & B Kieswetter, Kitchener, Canada

[21] Appl. No.: 788,448

[22] Filed: Nov. 6, 1991

[30] Foreign Application Priority Data

Nov. 13, 1990 [CA] Canada ..... 2029847

[51] Int. Cl.[5] ..... B28C 5/46; B01F 15/06

[52] U.S. Cl. ..... 366/24; 366/148

[58] Field of Search ..... 366/22, 23, 24, 44, 366/147, 148, 341, 4, 7, 25, 144; 404/79, 80, 92; 222/146.2, 146.4; 122/17

[56] References Cited

U.S. PATENT DOCUMENTS

| | | | |
|---|---|---|---|
| 2,648,206 | 8/1953 | Carr | 366/4 |
| 3,251,346 | 5/1966 | Merino | 122/17 |
| 3,804,079 | 4/1974 | Schrader | 404/79 |
| 3,832,201 | 8/1974 | Shearer | 366/147 |
| 4,197,014 | 4/1980 | Jinno | 366/24 |
| 4,442,798 | 4/1984 | Zanias | 122/17 |
| 4,817,564 | 4/1989 | Akkala | 122/17 |

*Primary Examiner*—Philip R. Coe
*Assistant Examiner*—Randall Edward Chin

[57] ABSTRACT

This invention describes a heating system for use with a mortar mixing unit. The heating system is comprised of a series of heat exchanging portions used to inhibit freezing of the materials used to prepare mortar in extremely cold weather conditions. The first heat exchanging portion is used to heat the water used to mix mortar. The second heat exchanging portion is used to warm the mixing unit, which contains the water, aggregate, and sand. The third heat exchanging portion is used to warm the aggregate, which is contained in a silo.

4 Claims, 1 Drawing Sheet

HEATER FOR A MORTAR PREPARATION SYSTEM

FIELD OF THE INVENTION

The present invention relates to an apparatus for heating materials required to produce mortar. More particularly, the present invention relates to the use of a high pressure burner used to control the temperature of the materials used in the mortar mixing process to inhibit freezing.

BACKGROUND OF THE INVENTION

Current mortar mixing apparatus do not function properly in cold weather. The mixing process typically involves combining an aggregate and a binder with water in such a fashion that the desired mixing ratio is obtained.

In extremely cold weather the aggregate, for example sand, may freeze due to the significant moisture content in the sand. The water used in the mixing process is also very susceptible to freezing. The binder, for example cement, is very dry and of relatively small volume and does not tend to become frozen in very cold conditions.

The mixing process is severely inhibited when the sand or water become frozen. As a result, the preparation of mortar becomes very difficult, if not impossible, in extremely cold weather.

PRIOR ART

Prior art techniques employed to operate a mortar preparation apparatus in cold weather have been restricted to small ineffective electric heating cables and elements, which do not operate properly in very cold weather.

Prior art techniques have also involved using tarpaulins to cover the entire mixing and silo portions of the apparatus. This method is not sufficient in extremely cold weather, because the tarpaulin merely acts as an insulating blanket not a heat source required to warm the mixing materials.

Other techniques involve using open flame burners directed into the aggregate (sand) reservoir portion of the silo. This is extremely unsafe and may cause condensation to build up on the walls of the silo, which will disadvantageously increase the moisture content of the binder (cement).

SUMMARY OF THE INVENTION

The present invention is a heating system used to warm the materials used in the preparation of mortar. The heating system was designed particularly for the MegaMix (TM) system. Such a system is disclosed in U.S. Pat. No. 4,855,960 which issued to Janssen et al. on Aug. 8, 1989. However, the present invention is in no way limited for use with the MegaMix (TM) system and a similar arrangement of heat exchangers can be used with other mortar preparation systems.

In accordance with an aspect of the invention there is provided a heating system for use with a mortar mixing unit which comprises a silo means for holding an aggregate and a binder; a water supply means; and a mixing unit connected to said silo means and said water supply means for mixing said aggregate, said binder and said water to produce said mortar; said heating system comprising:

(a) heat energy producing means for producing a supply of heat energy wherein said heat energy is comprised of products of combustion and air;

(b) a water reservoir means connected between said water supply means and said mixing unit; and (c) a heating tube means having a first end, a second end, and a heat exchanging portion located within said water reservoir means, said first end being connected to said heat energy producing means for conducting said heat energy into said heat exchanging portion, said second end forming an exhaust port; wherein water supplied to said mixing means is heated prior to mixing.

BRIEF DESCRIPTION OF THE DRAWINGS

The present invention will be described in detail hereinbelow with the aid of the accompanying drawings, in which.

DESCRIPTION OF THE PREFERRED EMBODIMENTS

Figure 1:
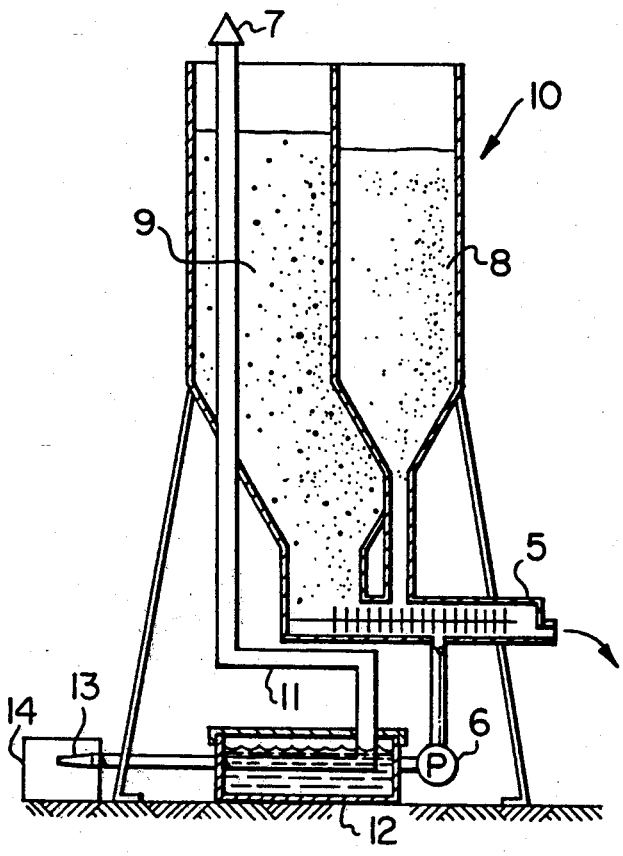
FIG. 1 is a schematic diagram which illustrates the present invention used in conjunction with a prior art mixer.

FIG. 1 illustrates the heating system of the present invention which includes a water tank 12 that is placed at the bottom of a silo 10. The water tank 12 can be either provided with a steady supply of water from a local water source (not shown) or filled and refilled from a larger reservoir (not shown) as required. Silo 10 is divided into two partitions, an aggregate portion 9 and a binder portion 8. A fire tube 13 enters the side of water tank 12 and continues a substantial distance into the tank 12. The fire tube 13 then turns through 90° and emerges upwardly through the top of tank 12 as pipe 11. The pipe 11 continues vertically up through aggregate portion 9 of silo 10 and out the top of silo 10 to an exhaust port 7 to exhaust warm air to the atmosphere. A heating unit 14 supplies the required heat energy to be directed into fire tube 13.

A first heat exchanger is established inside water tank 12 between the portion of fire tube 13 that is submerged in water within tank 12 and the water itself. Approximately 3 ft. of pipe contacts the water in tank 12. The heat exchange causes the temperature of the water in tank 12 to increase to about 110° F. The warmed water is then pumped into a mixing unit 5 by a water pump 6. The above mentioned water temperature is sufficient for the proper mixing of mortar even in very cold winter conditions.

A second heat exchanger is established between that portion of pipe 11 exposed to the air between water tank 12 and silo 10. The heat that radiates from pipe 11 in this region heats mixing unit 5 to prevent the materials from freezing during the mixing process.

A third heat exchanger is established between the portion of pipe 11 contained in aggregate portion 9 of silo 10, and the aggregate itself. The radiant heat from pipe 11 maintains the temperature of the aggregate and inhibits freezing.

The temperature of the heat energy that passes through fire tube 13 varies from approximately 800° F., but changes with ambient temperature, at the entrance to fire tube 13 to 250° F. at exhaust port 7. If the temperature at exhaust port 7 is lower than 250° F. the products of combustion may produce a condensate on the interior walls of silo 10.

Figure 2:
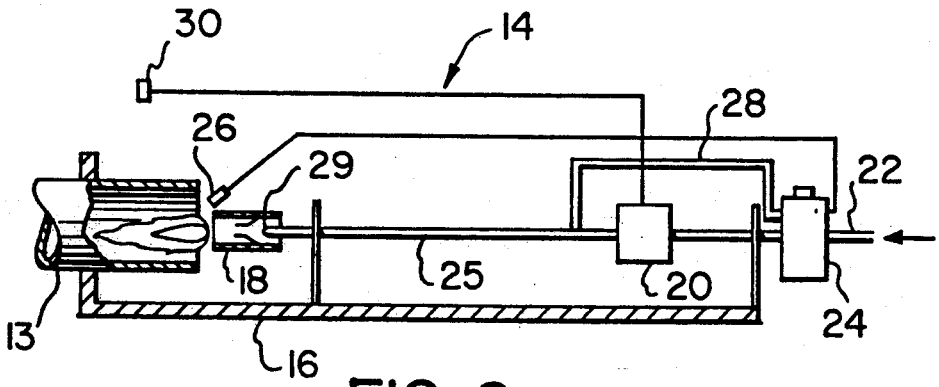
FIG. 2 is a schematic diagram which illustrates the components of the heating unit used with the present invention.

The heating unit 14, as shown in FIG. 2, is used to provide the required heat energy, in the form of the products of combustion and secondary air, into fire tube 13 and pipe 11. The components which make up heating unit 14 are connected to a supporting frame 16. The Insta-Flame (TM) brand of industrial propane heaters can be used as heating unit 14.

Propane gas is fed to heating unit 14 via a propane inlet 22. The gas is fed to the inlet of a shut off valve 24. Shut off valve 24 feeds both a low flame by-pass tube 28 and a main burner tube 25. The existence of a low flame in burner 18 heats a thermocouple 26 and maintains valve 24 in the open position. If, for any reason, the low flame in burner 18 goes out, thermocouple 26 would cool down and shut off all gas flow through valve 24.

The main burner tube 25 is connected to a burner nozzle 29 via a control valve 20. A water temperature sensor 30 detects the temperature of water in tank 12. In this particular embodiment, if the temperature of the water is below some predetermined temperature, sensor 30 sends a signal to control valve 20 to provide sufficient gas to nozzle 29 to gradually increase the heat energy supplied to fire tube 13. Eventually, the burner 18 reaches the maximum heat energy level that can be provided by heating unit 14. When the water has reached the predetermined value the flame is gradually lowered to a low flame maintenance state.

This low heat is sufficient to provide enough heat energy to maintain the water in tank 12 at the desired temperature, in this case about 110° F.

If no water is in tank 12, an operator can manually set burner 18 to a low flame state. This low heat is sufficient to maintain aggregate 9 in silo 10 at a temperature above freezing. In this configuration the mortar mixing unit is maintained in a standby condition either at the mixing site or when being transported.

In view of the above, two embodiments of the invention are provided. The first embodiment integrates water tank 12 and heating unit 14 with the mortar mixing apparatus so that the aggregate can be heated at all times including during transport of the mortar mixing apparatus. The other embodiment separates the mortar mixing apparatus from the heating unit 14 thereby allowing the heating unit 14 to be utilized only when needed at the mortar mixing site.

We claim:

1. A heating system for use with a mortar mixing unit, the mortar mixing unit comprising a silo having two sections, one for retaining an aggregate and the other for retaining a binder; and a mixing unit connected to the silo, wherein the aggregate, the binder and water are mixed in the mixing unit to produce mortar; said heating system comprising:

(a) heat energy producing means for producing a supply of heat energy, wherein said heat energy is comprised of products of combustion and air;

(b) water reservoir means connected to the mixing unit for retaining the water;

(c) a hollow pipe having a first end and a second end, the first end being connected to the heat energy producing means for heating the hollow pipe;

(d) a first heat exchanger comprising a first portion of the hollow pipe located within the water reservoir means, wherein the first portion of the hollow pipe heats the water prior to entering the mixing unit;

(e) a second heat exchanger comprising a second portion of the hollow pipe positioned proximate a substantial portion of the mixing unit, wherein the second portion of the hollow pipe heats the aggregate, binder and water contained in the mixing unit; and (f) a third heat exchanger comprising a third portion of the hollow pipe located within the aggregate section of the silo, wherein the third portion of the hollow pipe heats the aggregate prior to entering the mixing unit.

2. The heating system of claim 1, wherein the second end of the hollow pipe is located outside of the silo to exhaust warm air to the atmosphere.

3. The heating system of claim 1 or 2, further comprising pump means for drawing water from the water reservoir means to the mixing unit.

4. The heating system of claim 1, wherein the heat energy producing means is a gas burner.

* * * * *